US006009716A

United States Patent [19]

Aoto et al.

[11] Patent Number: 6,009,716

[45] Date of Patent: Jan. 4, 2000

[54] INTEGRAL AIR CONDITIONER WITH MOTORS FOR DRIVING INTERIOR AND EXTERIOR BLOWERS BOTH DISPOSED AT EXTERIOR SIDE

[75] Inventors: Yoshiyuki Aoto; Kazuya Yoshikawa; Yuki Kawano, all of Osaka; Tomiji Ikarashi, Wakayama; Toshiya Ueno, Osaka, all of Japan

[73] Assignee: Sharp Kabushiki Kaisha, Osaka, Japan

[21] Appl. No.: 08/971,363

[22] Filed: Nov. 17, 1997

[30] Foreign Application Priority Data

Nov. 22, 1996 [JP] Japan ..... 8-311602
Nov. 28, 1996 [JP] Japan ..... 8-317199

[51] Int. Cl.[7] ..... F25D 23/12

[52] U.S. Cl. ..... 62/262; 62/263

[58] Field of Search ..... 62/262, 263, 176.6, 62/129

[56] References Cited

U.S. PATENT DOCUMENTS 5,197,299 3/1993 Sohn et al. ..... 62/262
5,228,306 7/1993 Shyu et al. ..... 62/262

FOREIGN PATENT DOCUMENTS 2110220 4/1990 Japan .
4020725 1/1992 Japan .
5001831 1/1993 Japan .
5-33960 2/1993 Japan .
5-196252 8/1993 Japan .
5288397 11/1993 Japan .
7-158890 6/1995 Japan .

*Primary Examiner*—Henry Bennett
*Assistant Examiner*—Melvin Jones
*Attorney, Agent, or Firm*—Birch, Stewart, Kolasch & Birch, LLP

[57] ABSTRACT

An integral type air conditioner includes an interior heat exchanger, an interior blower, an exterior heat exchanger, an exterior blower, an interior motor, and an exterior motor. In addition, a partition member separates the interior heat exchanger and the interior blower at the interior side from the exterior heat exchanger, the exterior blower, the interior motor and the exterior motor at the exterior side.

5 Claims, 6 Drawing Sheets

INTEGRAL AIR CONDITIONER WITH MOTORS FOR DRIVING INTERIOR AND EXTERIOR BLOWERS BOTH DISPOSED AT EXTERIOR SIDE

BACKGROUND OF THE INVENTION

1. Field of the Invention

The present invention relates to an integral type air conditioner in which reduction of noises and an enhanced operational efficiency are achieved.

2. Description of the Background Art

Referring to FIG. 1, a conventional integral type air conditioner has a body 21 constituted of a front grille 22, an outer case 23 and an internal unit (not shown) provided within outer case 23. Referring to FIG. 2 showing a plan cross section view of the conventional integral type air conditioner, an internal unit 24 is provided with a bulkhead 26 (partition member) set upright on a base board 25 for dividing the internal unit into an exterior side and an interior side.

A structure at the exterior side is first described. A condenser 27 (exterior heat exchanger) is disposed at the exterior side. Condenser 27 is disposed opposite to bulkhead 26.

Between bulkhead 26 and condenser 27, a propeller fan (exterior blower) 29 having a slinger ring for splashing drain water is disposed. Propeller fan 29 is attached to an axis at the exterior side of a fan motor 30. Further, an air guider 32 which guides air from propeller fan 29 is placed around propeller fan 29. A compressor 34 compresses the refrigerant and sends it to condenser 27.

A structure at the interior side is next described. An evaporator 35 (interior heat exchanger) is provided at the interior side. A sirocco fan 36 (interior blower) is placed between evaporator 35 and bulkhead 26. Sirocco fan 36 is attached to an axis at the interior side of the fan motor 30. In addition, a casing 37 forms a flow passage through which air from sirocco fan 36 is guided. A water receiver 38 is further provided below evaporator 35 for collecting low temperature drain water generated in evaporator 35 and guiding it from the interior side to the exterior side.

In the conventional integral air conditioner, sirocco fan 36 and propeller fan 29 are driven by a single fan motor 30. Therefore, the speed of rotation of sirocco fan 36 at the interior side should be matched to that of propeller fan 29 which requires a high speed of rotation. As a result, the speed of rotation of sirocco fan 36 becomes higher than necessary, and a blowing noise generated by sirocco fan 36 increases to produce a leaking noise at the interior side. The positions where sirocco fan 36 and propeller fan 29 are respectively placed are limited by fan motor 30, and an arrangement for achieving effective gas quantity, air speed or the like is difficult to make.

A description of a packaging member for the conventional integral type air conditioner is given below. Referring to FIG. 3, the conventional packaging member is constituted of a base plate 44, a case 45, side plates 46*a* and 46*b*, a bolt 47 and a top plate 41.

When the conventional integral air conditioner is packaged, integral air conditioner 21 is placed on base plate 44, and secured to base plate 44 with bolt 47. The side surfaces of integral air conditioner 21 are covered with side plates 46*a* and 46*b*, and integral air conditioner 21 and side plates 46*a* and 46*b* are housed in case 45. Top plate 41 is placed on the top surface of integral air conditioner 21, the upper part of case 45 is closed, and packaging is completed.

Without top plate 41, a concave portion is generated at the top surface of the cabinet of the packaged integral air conditioner 21 when a drop test is applied.

Such packaging member is currently discarded all together as useless after the installation of integral air conditioner 21. However, it should be pointed out that the packaging member is treated as waste, which must not be overlooked in the current worldwide trend of environmental protection.

The conventional packaging member as described above is discarded all together after the installation of integral type air conditioner 21, and the costs for dealing with waste are required. Therefore, the waste resulting from the conventional packaging member should be reduced as much as possible.

SUMMARY OF THE INVENTION

An object of the present invention is to provide an integral type air conditioner which produces less noise and achieves an efficient operation.

According to one aspect of the invention, an integral type air conditioner includes: an interior heat exchanger for heat exchanging of an interior air; interior blower for blowing the interior air after the heat exchanging by the interior heat exchanger; an exterior heat exchanger for heat exchanging of exterior air; an exterior blower for blowing the exterior air after the heat exchanging by the exterior heat exchanger; an interior motor for driving the interior blower; an exterior motor for driving the exterior blower; and a partition member for dividing components by placing the interior heat exchanger and the interior blower at the interior side and placing the exterior heat exchanger, the exterior blower, the interior motor and the exterior motor at the exterior side.

The interior blower and the exterior blower can be driven respectively at different speeds of rotation by driving them by different motors respectively. As a result, interior noise can be reduced by reducing the speed of rotation of the interior blower. Interior noise is further reduced by providing the interior and exterior motors both at the exterior side. In addition, an integral type air conditioner having a good operating efficiency can be provided since the interior heat exchanger, the interior blower and the interior motor can be properly positioned.

The foregoing and other objects, features, aspects and advantages of the present invention will become more apparent from the following detailed description of the present invention when taken in conjunction with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS (First Embodiment)

Figure 1:
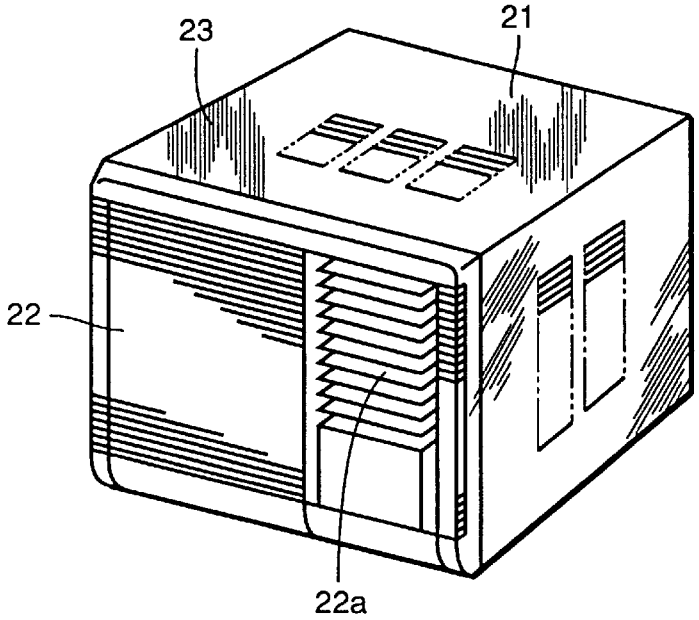
FIG. 1 PRIOR ART
FIG. 1 is a perspective view of a conventional integral type air conditioner.
Figure 2:
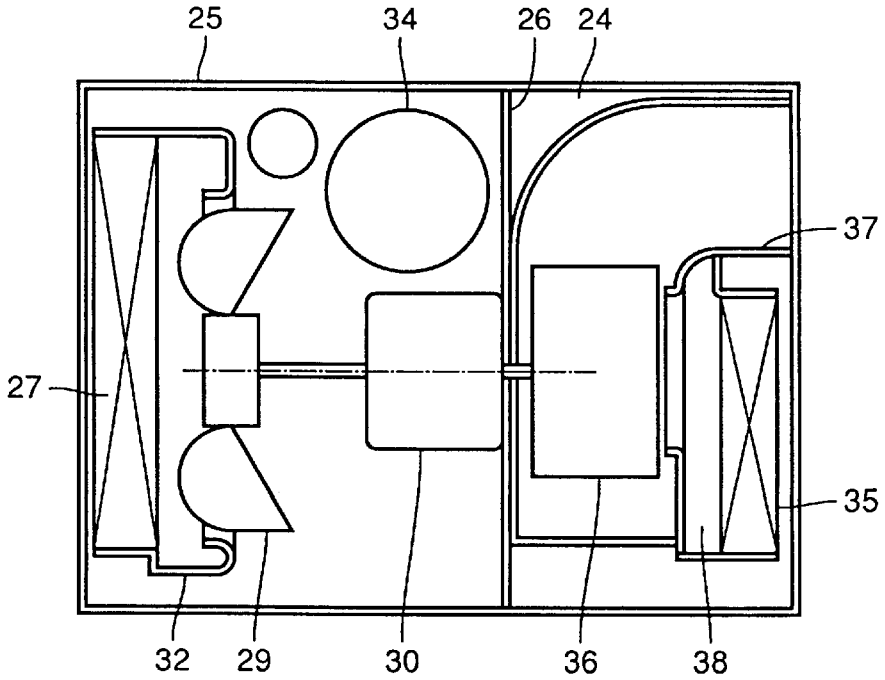
FIG. 2 PRIOR ART
FIG. 2 is a plan cross sectional view of the conventional integral type air conditioner.
Figure 3:
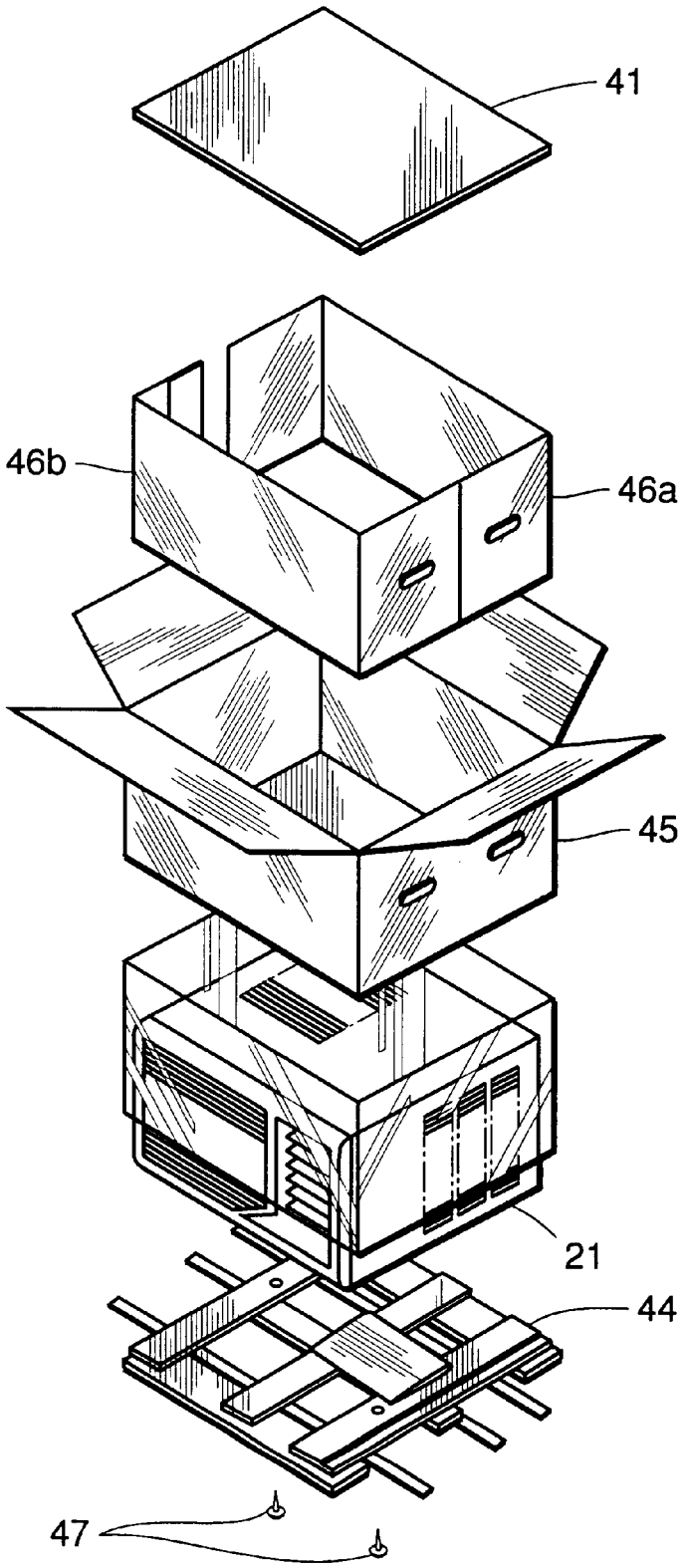
FIG.3 PRIOR ART
FIG. 3 is provided for describing a structure of a packaging member for the conventional air conditioner.
Figure 4:
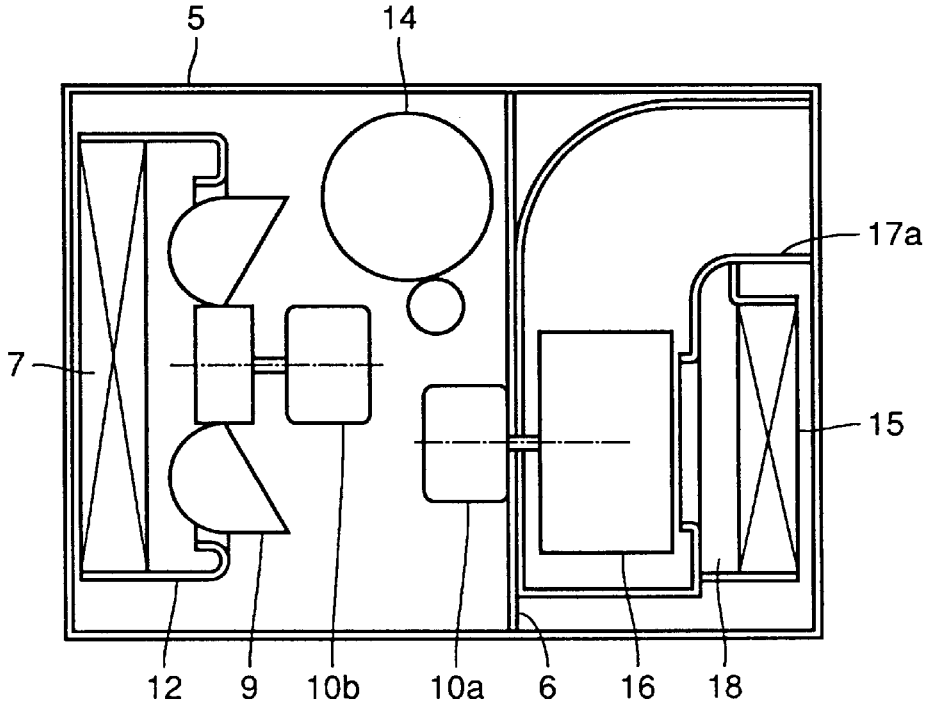
FIG. 4 is a plan cross sectional view of a first embodiment of an integral type air conditioner according to the present invention.

With reference to FIG. 4 showing a plan cross section view of the first embodiment, a bulkhead (partition member) 6 for dividing an interior compartment into an exterior side and an interior side is set upright. A condenser (exterior heat exchanger) 7 is disposed at the exterior side, and placed opposite to bulkhead 6. A propeller fan (exterior blower) 9 is attached to an axis of an exterior motor 10*b*. An air guider 12 is placed around propeller fan 9 for guiding air from propeller fan 9.

The interior side is described. An evaporator (interior heat exchanger) 15 is placed in the interior side and a sirocco fan (interior blower) 16 is provided between evaporator 15 and bulkhead 6 at the interior side. Sirocco fan 16 is attached to an axis of an interior motor 10*a*. A flow passage, through which air from sirocco fan 16 is guided, is formed by a casing 17*a*. A water receiver 18 for collecting low temperature drain water generated in evaporator 15 and guiding the drain water from the interior side to the exterior side is provided below evaporator 15.

The speed of rotation of interior motor 10*a* is set lower than that of exterior motor 10*b*, so that noise due to blowing or the like generated by sirocco fan 16 at the interior side can be reduced. Since respective fans are provided with dedicated exterior motor 10*b* and interior motor 10*a*, evaporator 15, sirocco fan 16 and interior motor 10*a* can be properly positioned. As a result, gas quantity, air speed and the like are balanced to enable noise to be reduced and the operating efficiency to be enhanced.

Regarding the exterior side of the conventional integral type air conditioner, setting of the speed of rotation of propeller fan 9 at a proper value was difficult due to the need for matching the speed to the speed of rotation of sirocco fan 16. However, propeller fan 9 of the present invention is easily rotated at a proper speed of rotation by providing a dedicated exterior motor 10*b*. Proper positioning of condenser 7, propeller fan 9 and exterior motor 10*b* was conventionally difficult. For example, the center of condenser 7 is deviated from the position of sirocco fan 16. By providing dedicated exterior motor 10*b*, proper arrangement is possible to enable gas quantity, air speed and the like to be balanced. As a result, reduction of noise and enhancement of the operating efficiency are achieved. Further, by providing interior motor 10*a* and exterior motor 10*b* at the exterior side, reduction of interior noise as well as reduction of influence of heat generated by interior motor 10*a* on internal temperature are achieved.

In FIG. 4, reference numeral 5 is a base board and reference numeral 14 is a compressor.

(Second Embodiment)

Figure 5:
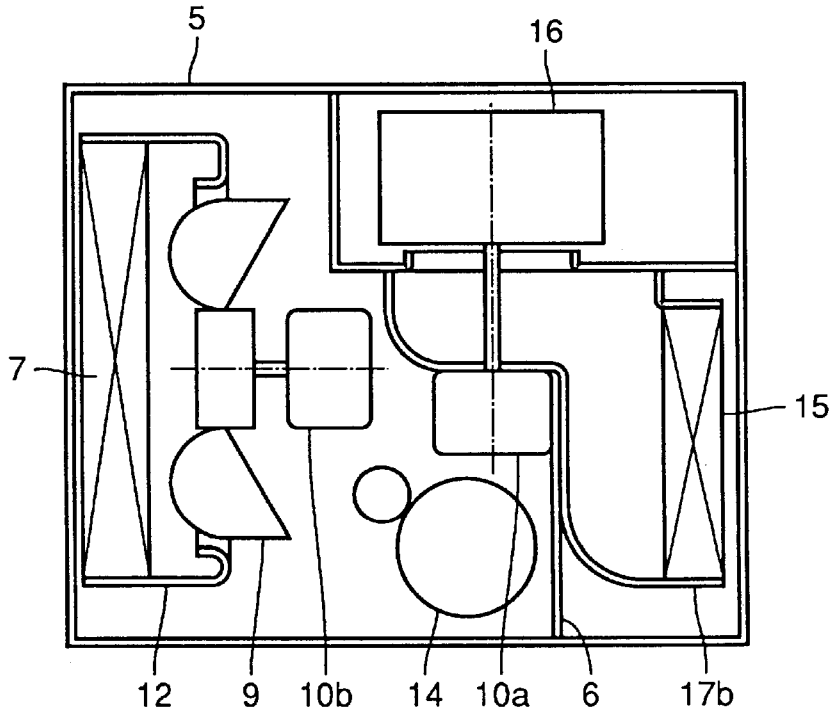
FIG. 5 is a plan cross sectional view of a second embodiment of an integral type air conditioner according to the invention.

Referring to FIG. 5, a plan cross section view of the second embodiment is illustrated. A difference between an integral type air conditioner of the second embodiment and that of the first embodiment shown in FIG. 4 is that sirocco fan 16 and evaporator 15 are arranged such that the longitudinal direction of sirocco fan 16 and that of evaporator 15 are perpendicular to each other. Furthermore, interior air passing through evaporator 15 is guided toward sirocco fan 16 by a casing 17*b* in the second embodiment. A detailed description of other structures and functions similar to those of the first embodiment is not repeated here. This arrangement provides an effect similar to that described concerning the first embodiment.

(Third Embodiment)

Figure 6:
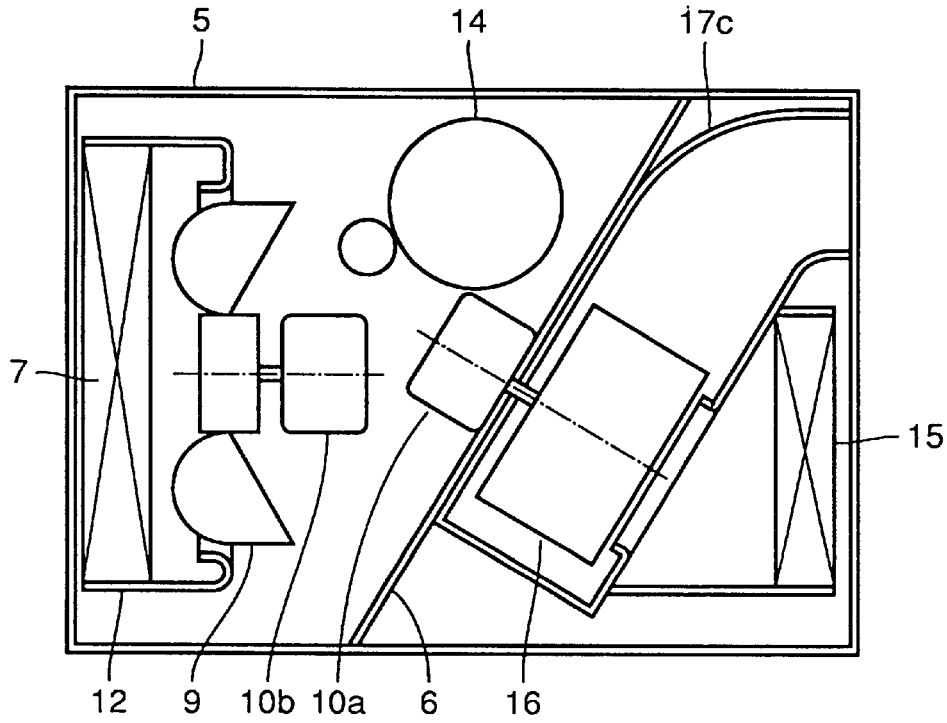
FIG. 6 is a plan cross sectional view of a third embodiment of an integral type air conditioner according to the invention.

Referring to FIG. 6, showing a plan cross section view of the third embodiment is illustrated. A difference between the integral type air conditioner according to the first embodiment shown in FIG. 4 and that according to the third embodiment is that sirocco fan 16 and evaporator 15 are arranged such that the longitudinal direction of sirocco fan 16 and that of evaporator 15 are oblique to each other, and air from sirocco fan 16 is guided by a casing 17*c* in the third embodiment. A detailed description of similar structures and functions is not repeated here. This arrangement provides an effect similar to that described concerning the first embodiment.

(Fourth Embodiment)

Figure 7:
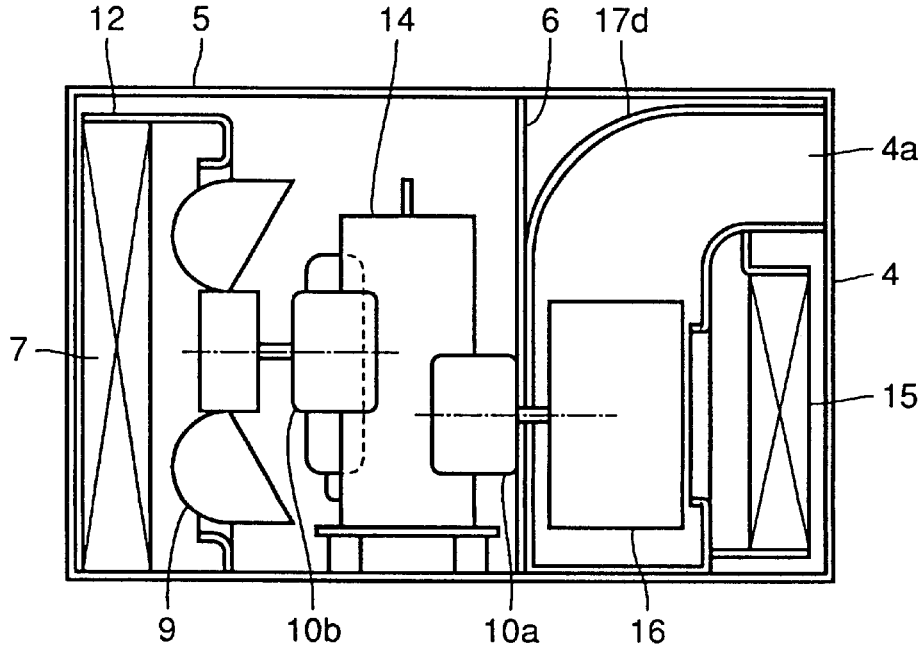
FIG. 7 is a side cross sectional view of a fourth embodiment of an integral type air conditioner according to the invention.

Referring to FIG. 7, a side cross section view of the fourth embodiment is illustrated. In an integral type air conditioner according to the fourth embodiment, sirocco fan 16 and evaporator 15 are disposed such that the longitudinal direction of sirocco fan 16 and that of evaporator 15 are parallel with each other as in the integral type air conditioner according to the first embodiment shown in FIG. 4. A difference is that a supply opening 4*a* formed at a front grille 4 at the interior side is placed above evaporator 15, not at the side surface of evaporator 15. Reference numeral 17*d* is a casing. A detailed description of similar structures and functions is not repeated here. This arrangement also provides an effect similar to that described concerning the first embodiment.

As heretofore described, the integral type air conditioner of the present invention is provided with separate interior motor 10*a* and exterior motor 10*b*. Therefore, the speed of rotation of interior motor 10*a* and that of exterior motor 10*b* can be set independently of each other. Therefore internal and external heat exchanging efficiencies can be optimized. By reducing the speed of rotation of interior blower 16, reduction of noise is achieved. Freedom to position the interior and exterior heat exchangers 7 and 15, and blowers 9 and 16 increases to optimize interior and exterior heat exchanging efficiencies. Since interior motor 10*a* is placed at the exterior side using the partition member 6, radiation of heat and noise from interior motor 10*a* do not affect the interior side so much. Further, by increasing the speed of rotation of exterior blower 9, an efficient cooling (heat dissipation) of the interior motor 10*a* is achieved. Since exterior blower 9 is located at the exterior side about partition member 6, increase of the speed of rotation does not affect interior noises as much as interior blower 16 does.

(Fifth Embodiment)

Recycling of a packaging member for an integral type air conditioner is next described. Although a basic structure of the packaging member for the air conditioner is similar to that described concerning that of the conventional type, a top plate 1 used as a buffer material is employed as a sun shade (light blocking plate).

Figure 8:
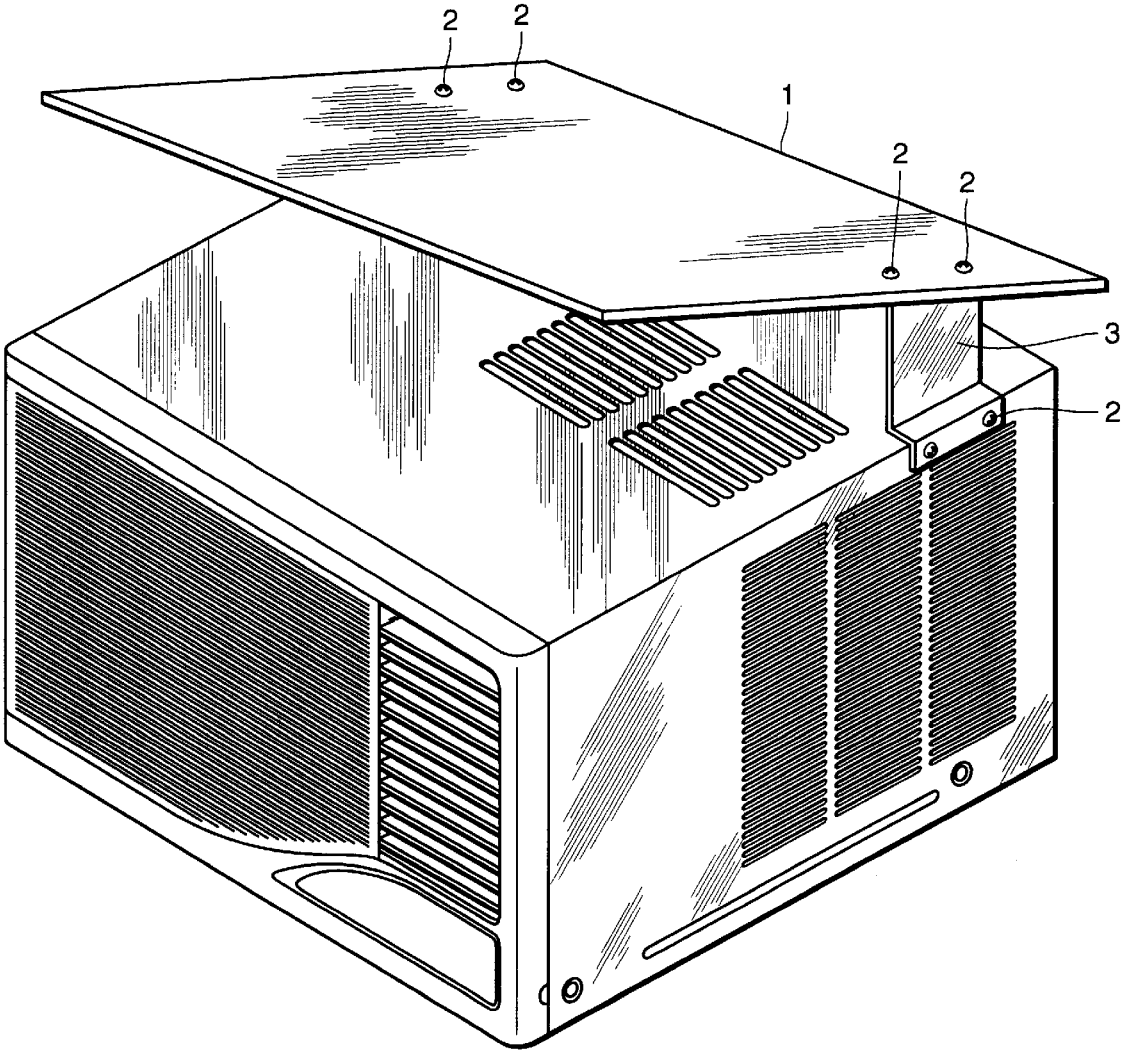
FIG. 8 is a perspective view of a packaging member for an integral type air conditioner according to the invention.

The integral type air conditioner is arranged to extend over the interior side and exterior side at a prescribed position for placement (an opening for placement formed at a wall). A part of the integral type air conditioner is exposed at the exterior side. Referring to FIG. 8, on a top surface of the exposed portion at the exterior side of the integral type air conditioner, top plate 1 constituting the packaging member as a sun shade is placed with a pair of stays 3 (supporting member). Top plate 1 undergoes waterproof treatment and is attached in a tilted manner. The color of top plate 1 is preferably the same as that of the outer case of the integral type air conditioner considering goodness of design.

Figure 9:
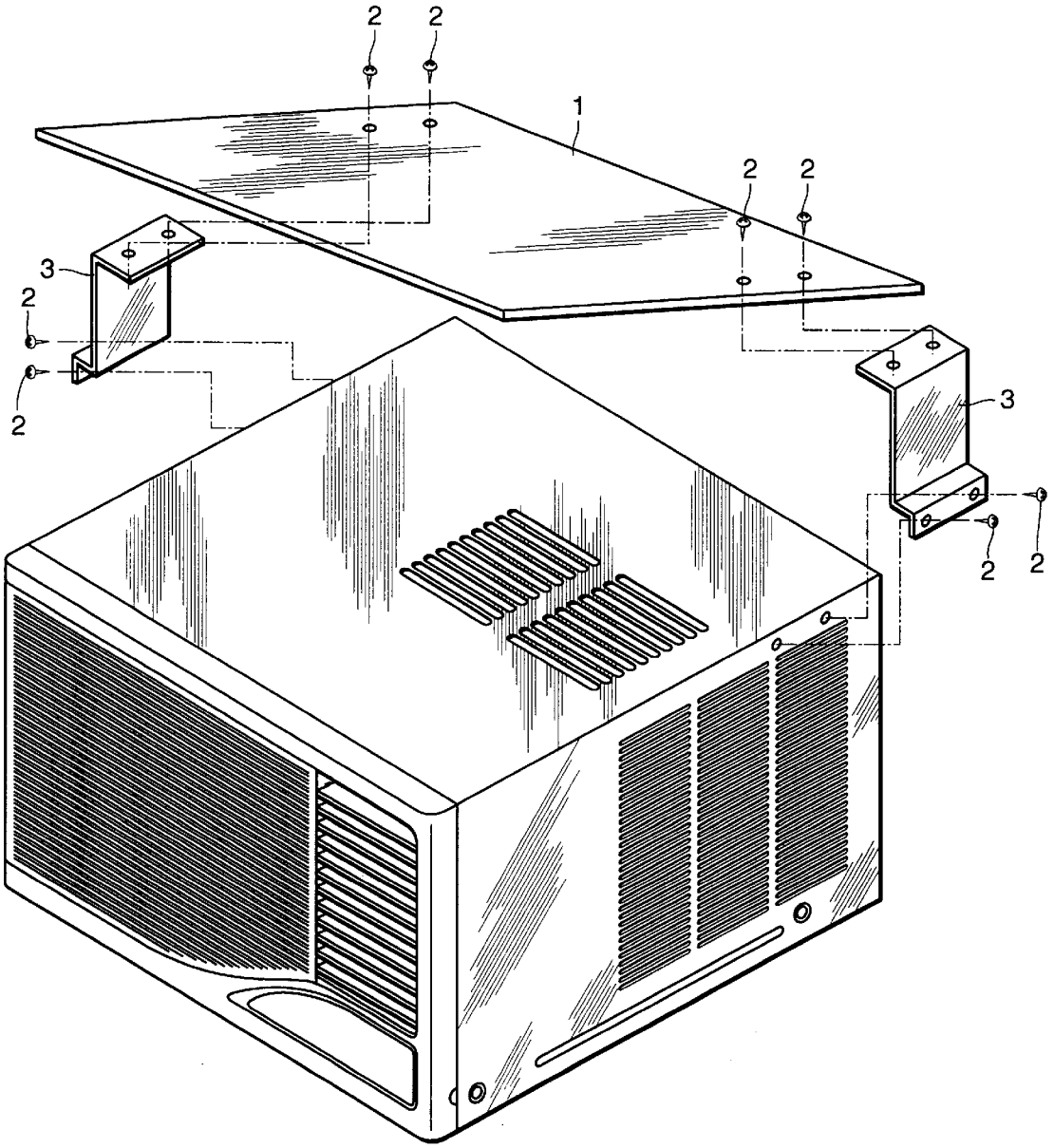
FIG. 9 shows a structure of attachment of the packaging member shown in FIG. 8.

Referring to FIG. 9, a surface for attachment to top plate 1 to be tilted toward the top surface of the integral type air conditioner is formed at the upper end portion of stay 3, and top plate 1 is attached to the attachment surface with screws 2. Stay 3 is next attached to the upper portion of the outer case of the integral type air conditioner with screws 2. Specifically, screw holes are respectively formed at upper end portions of both sides of the outer case of the integral type air conditioner. The lower portion of stay 3 is attached with screws 2 through the screw hole.

The structure described above prevents the upper surface of the integral type air conditioner from being exposed to direct sunlight, and further prevents cooling efficiency from decreasing due to overheating of the upper surface of the integral type air conditioner by direct sunlight in midsummer. Further, degradation of the coating of the upper surface of the air conditioner due to direct sunlight is prevented. Since top plate 1 is tilted in relation to the top surface of the air conditioner, rain water can be caused to flow in a prescribed direction.

In addition, since top plate 1 and the top surface of the exposed portion at the exterior side of the air conditioner are separated by a prescribed distance using stay 3, top plate 1 never prevents cooling by the integral type air conditioner. By employing top plate 1 as a sun shade, decrease of the cooling ability of the integral type air conditioner as well as degradation of the coating or the like of the outer case due to the direct sunlight can be prevented.

The position of attachment of stay 3 to the integral type air conditioner can be changed by providing holes for the stay attachment at a plurality of positions. Specifically, although top plate 1 is arranged above the top surface at the exterior side of the integral type air conditioner in this embodiment, top plate 1 may be arranged at the side portion of the air conditioner via stay 3 using holes for attachment of the stay formed at the side surface if the side surface needs to be protected or flowing of discharged air at the side surface is not desirable. As a result, any influence of anything bumping against the side surface and flowing of discharged air at the side surface can be prevented.

In those regions where heavy snow falls, the angle of attachment of top plate 1 to the top surface at the exterior side of the integral type air conditioner may be large enough to prevent snow from being piled up on top plate 1. Although top plate 1 is provided to be tilted in relation to the top surface at the exterior side of the integral type air conditioner, top plate 1 may be arranged horizontally.

Although a description of the integral type air conditioner is given in the fifth embodiment, the embodiment can be applied to the exterior device of a separate type air conditioner.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An integral type air conditioner comprising:

an interior heat exchanger for heat exchanging of interior air;

an interior blower for blowing the interior air after the heat exchanging by said interior heat exchanger;

an interior supply opening provided above said interior heat exchanger, the interior air blown by said interior blower is blown off through said interior supply opening;

an exterior heat exchanger for heat exchanging of exterior air;

an exterior blower for blowing the exterior air after the heat exchanging by said exterior heat exchanger;

an interior motor for driving said interior blower;

an exterior motor for driving said exterior blower; and a partition member for dividing said interior heat exchanger and said interior blower at an interior side from said exterior heat exchanger, said exterior blower, said interior motor and said exterior motor at an exterior side, and wherein a speed of rotation of said interior motor is lower than a speed of rotation of said exterior motor.

2. An integral type air conditioner comprising:

an interior heat exchanger for heat exchanging of interior air;

an interior blower for blowing the interior air after the heat exchanging by said interior heat exchanger;

an interior supply opening provided above said interior heat exchanger, the interior air blown by said interior blower is blown off through said interior supply opening;

an exterior heat exchanger for heat exchanging of exterior air;

an exterior blower for blowing the exterior air after the heat exchanging by said exterior heat exchanger;

an interior motor for driving said interior blower;

an exterior motor for driving said exterior blower; and a partition member for dividing said interior heat exchanger and said interior blower at an interior side from said exterior heat exchanger, said exterior blower, said interior motor and said exterior motor at an exterior side, and wherein a speed of rotation of said interior blower driven by said interior motor is lower than a speed of rotation of said exterior blower driven by said exterior motor.

3. An integral type air conditioner comprising:

an interior heat exchanger for heat exchanging of interior air;

an interior blower for blowing the interior air after the heat exchanging by said interior heat exchanger;

an interior supply opening provided above said interior heat exchanger, the interior air blown by said interior blower is blown off through said interior supply opening;

an exterior heat exchanger for heat exchanging of exterior air;

an exterior blower for blowing the exterior air after the heat exchanging by said exterior heat exchanger;

an interior motor for driving said interior blower;

an exterior motor for driving said exterior blower; and a partition member for dividing said interior heat exchanger and said interior blower at an interior side from said exterior heat exchanger, said exterior blower, said interior motor and said exterior motor at an exterior side, and wherein a longitudinal direction of said interior heat exchanger is parallel with a longitudinal direction of said interior blower.

4. An integral type air conditioner comprising:

an interior heat exchanger for heat exchanging of interior air;

an interior blower for blowing the interior air after the heat exchanging by said interior heat exchanger;

an interior supply opening provided above said interior heat exchanger, the interior air blown by said interior blower is blown off through said interior supply opening;

an exterior heat exchanger for heat exchanging of exterior air;

an exterior blower for blowing the exterior air after the heat exchanging by said exterior heat exchanger;

an interior motor for driving said interior blower;

an exterior motor for driving said exterior blower; and a partition member for dividing said interior heat exchanger and said interior blower at an interior side from said exterior heat exchanger, said exterior blower, said interior motor and said exterior motor at an exterior side, and wherein a longitudinal direction of said interior heat exchanger is perpendicular to a longitudinal direction of said interior blower.

5. An integral type air conditioner comprising:

an interior heat exchanger for heat exchanging of interior air;

an interior blower for blowing the interior air after the heat exchanging by said interior heat exchanger;

an interior supply opening provided above said interior heat exchanger, the interior air blown by said interior blower is blown off through said interior supply opening;

an exterior heat exchanger for heat exchanging of exterior air;

an exterior blower for blowing the exterior air after the heat exchanging by said exterior heat exchanger;

an interior motor for driving said interior blower;

an exterior motor for driving said exterior blower; and a partition member for dividing said interior heat exchanger and said interior blower at an interior side from said exterior heat exchanger, said exterior blower, said interior motor and said exterior motor at an exterior side, and wherein a longitudinal direction of said interior heat exchanger is oblique to a longitudinal direction of said interior blower.

* * * * *